United States Patent [19]

Hessmert

[11] Patent Number: 4,799,592

[45] Date of Patent: Jan. 24, 1989

[54] STACKABLE CRATES OF SYNTHETIC MATERIAL FOR BOTTLES, ESPECIALLY WINE BOTTLES

[75] Inventor: Gustav-Adolf Hessmert, Lüdenscheid, Fed. Rep. of Germany

[73] Assignee: Gustav Hessmert KG, Lüdenscheid, Fed. Rep. of Germany

[21] Appl. No.: 556,438

[22] Filed: Nov. 30, 1983

[51] Int. Cl.[4] ..... B65D 21/02; B65D 1/24

[52] U.S. Cl. ..... 206/504; 220/21; 220/23.6; 206/501

[58] Field of Search ..... 206/501, 504; 220/21, 220/23.6

[56] References Cited

U.S. PATENT DOCUMENTS

| | | | |
|---|---|---|---|
| 1,542,115 | 6/1925 | Weis | 220/4 D |
| 3,151,761 | 10/1964 | Cloyd | 220/21 |
| 3,809,279 | 5/1974 | Arjas | 220/21 |
| 3,998,328 | 12/1976 | Box | 220/21 |

FOREIGN PATENT DOCUMENTS

| | | | |
|---|---|---|---|
| 796156 | 10/1968 | Canada | 206/504 |
| 1182137 | 11/1964 | Fed. Rep. of Germany | 206/504 |
| 2307483 | 8/1974 | Fed. Rep. of Germany | 206/203 |
| 1579293 | 7/1969 | France | 206/504 |

*Primary Examiner*—George E. Lowrance

*Attorney, Agent, or Firm*—Harness, Dickey & Pierce

[57] ABSTRACT

Stackable crates of synthetic material for bottles, especially wine bottles, having a compartmental subdivision for the accommodation of one bottle each in one compartment, first supporting surfaces for stacking the crates one upon another in a vertical position, second supporting surfaces at at least two opposite side walls for stacking the crates in a horizontal position, with each compartment comprising portions of elastically shapable material adapted to be brought into engagement with the bottle wall at circumferentially spaced intervals, and with two sizes of crates provided, of which the smaller crates—measured outside—are half the length of the greater crates but the same width, and in that the second supporting surface are arranged in such a manner that the supporting surfaces of the smaller crates may respectively be supported by supporting surfaces of both halves of the side walls of the greater crates, and the greater crates may respectively be supported in the horizontal position while being respectively offset from each other by half a length.

8 Claims, 6 Drawing Sheets

STACKABLE CRATES OF SYNTHETIC MATERIAL FOR BOTTLES, ESPECIALLY WINE BOTTLES

Figure 1:
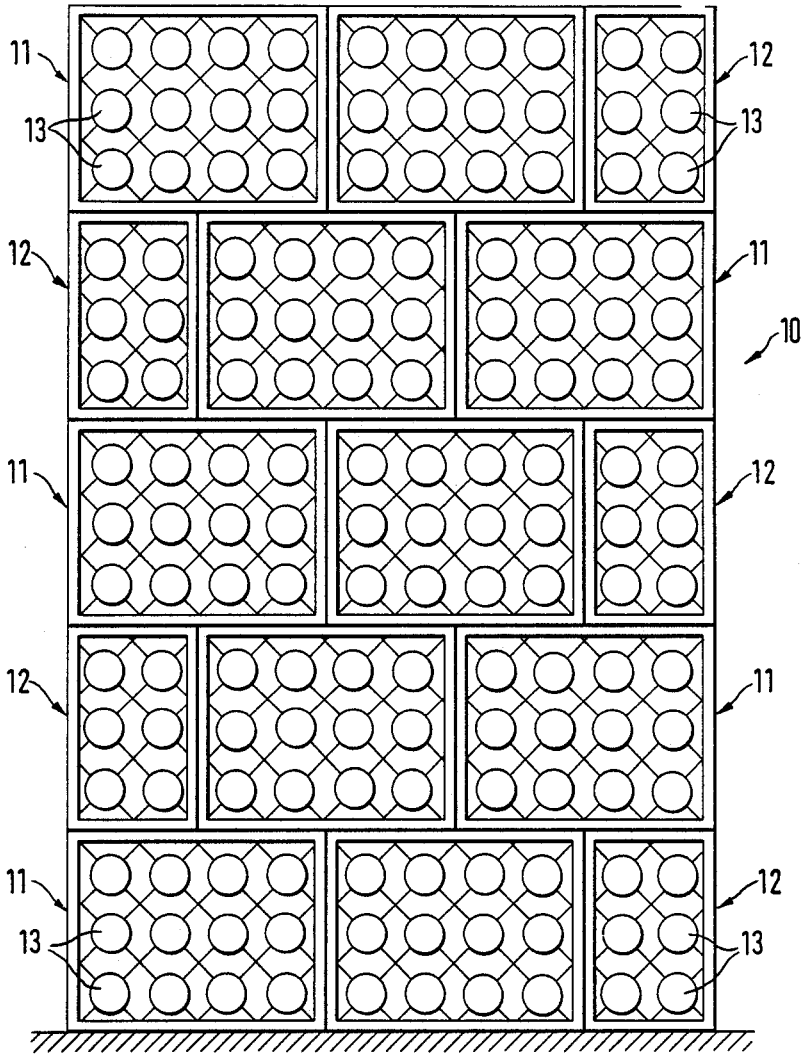

Stackable crates of synthetic material for bottles have become known from German patent letter No. 2 616 353. They offer the advantage of accommodating the bottles in such a manner that they may be received in a horizontal position. It is well known that wine bottles are to be stored in a horizontal position. For this purpose, known crates are provided with supporting surfaces at two opposite side walls for stacking the crates in a horizontal position. The compartments have lamina-shaped webs or arcuate wall segments of elastically shapable material adapted to be clampingly engaged with the bottle wall at circumferentially spaced intervals.

With the aid of such crates, one and the same crate can be used from the racking works to the consumer without there being any necessity of having to take out the bottles in between, for instance, for intermediate storage, and reinsert them again into the crates, respectively. With the aid of such crates, thus, storage and transport expenses per bottle are substantially reduced. Besides, such a crate when erected as a bottle rack offers a substantial saving in space as compared to conventional rack constructions.

As already explained above, such crates are formed of synthetic material. It goes without saying that in order to save weight and synthetic material only a minimum amount of synthetitc material is used for such crates. From a greater stacking height on, this affects the stability of the stack, especially when the crates are stacked in a horizontal position. While when stacking in a vertical position four chest walls are respectively contributing towards offering support, the forces will be accommodated substantially by only two side walls with the crate disposed in a horizontal position, if one ignores of once the compartmental subdivision in the interior of the crate.

It is therefore the object of the invention here to provide a remedy by providing stackable crates enabling a greater stacking height without the individual crates thereby becoming two expensive.

With the known crate the individual compartments have associated thereto elastically shapable portions clampingly surrounding the bottles. When racking using the conventional racking machines the danger exists that upon insertion of the bottles the labels freshly stuck to the bottles will become displaced or may become damaged by the flexible portions. Besides, the conventional racking and packing machines often are designed in such a manner that the bottles will drop under inertia into containers disposed therebelow. Flexible portions which are getting into clamping engagement with the bottle wall may possibly prevent the introduction of the bottle solely by inertia.

It is therefore another object of the invention to provide a crate wherein the labels are spared during the introduction of the bottle. Furthermore, the bottles are to be capable of being inserted into the compartments possibly without any additional pressure.

With the crate according to the invention two different sizes are provided, one size being one half that of the other one. The width of the basic area is to be the same, while the length of the smaller crate is reduced by one half. The greater crates may for instance accommodate twelve bottles, the smaller ones six. The supporting surfaces at the side walls serving the purpose of stacking the crates in a horizontal position, now, are designed in such a manner that the greater crates are stacked in a compound arrangement, i.e. respectively offset from each other by half a length. The gaps then remaining at the sides of a stack correspond to the length of a smaller crate, so that the smaller crate serves to fill this gap. A stack built up using such crates allows a much higher stacking height than when using the known crates.

The second supporting surfaces at the side walls of the greater crates thus must be designed in such a manner that the smaller crates may respectively be rested on one half of the side wall. It goes without saying that it is advantageous to design the supporting surfaces of the opposite side walls in such a manner that it does not matter on which side wall the chest is rested in the horizontal position.

A higher degree of safety is of course obtained, when the two supporting surfaces form an interlocking engagement with the aid of arresting projections and deepenings getting into engagement with each other. Such arresting projections and deepenings are mostly arranged at at least two opposite side walls at the greater crates according to a raster dimension in such a manner that the greater crates may be stacked in a horizontal position either offset from each other by half a length or directly one above another. The arresting projections and deepenings at the side wall of the smaller crates, therefore, correspond to those of one half of a side wall.

With a crate system comprising two differently sized crates as regards the basic surface thereof (the height thereof naturally is also preferably the same) it is recommendable also to design the first supporting surfaces in such a manner that stacking in a vertical position will be possible in the compound arrangement. Here, the same viewpoints hold true as those regarding the supporting surfaces and arresting deepenings and arresting projections, respectively, for the side walls.

In order to prevent damaging of the labels during insertion of the bottles but, on the other hand, enable safe accommodation of the bottles also in a horizontal position, the elastically shapable portions are relatively flexible in the direction of insertion and pulling out, respectively, however, in a direction normal thereto they are relatively stiff. For this purpose, relatively thin laminae may be used extending substantially normal to the direction of insertion. Such laminae may furthermore be designed in such a manner that they are more easily shapable in the direction of insertion than in the opposite direction. This may be obtained for instance by a weakening which, though effective in the direction of insertion, will be effective only partially in the opposite direction.

Figure 2:
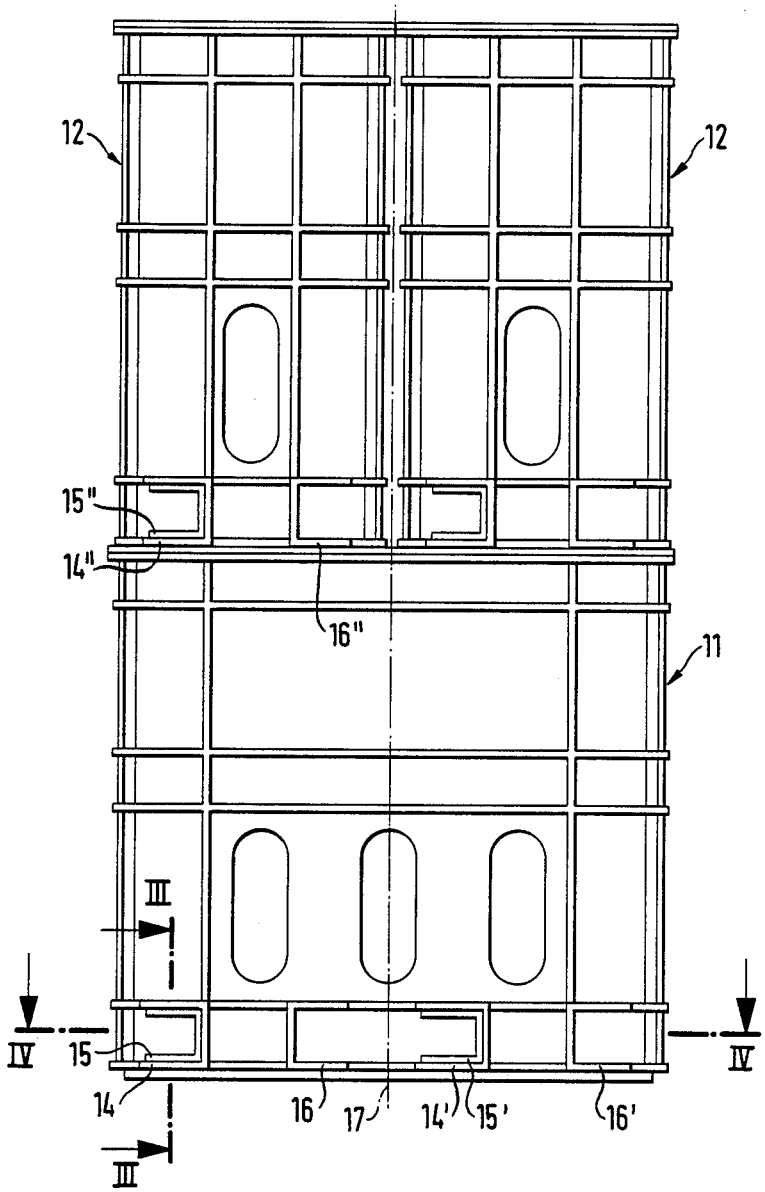
Figure 3:
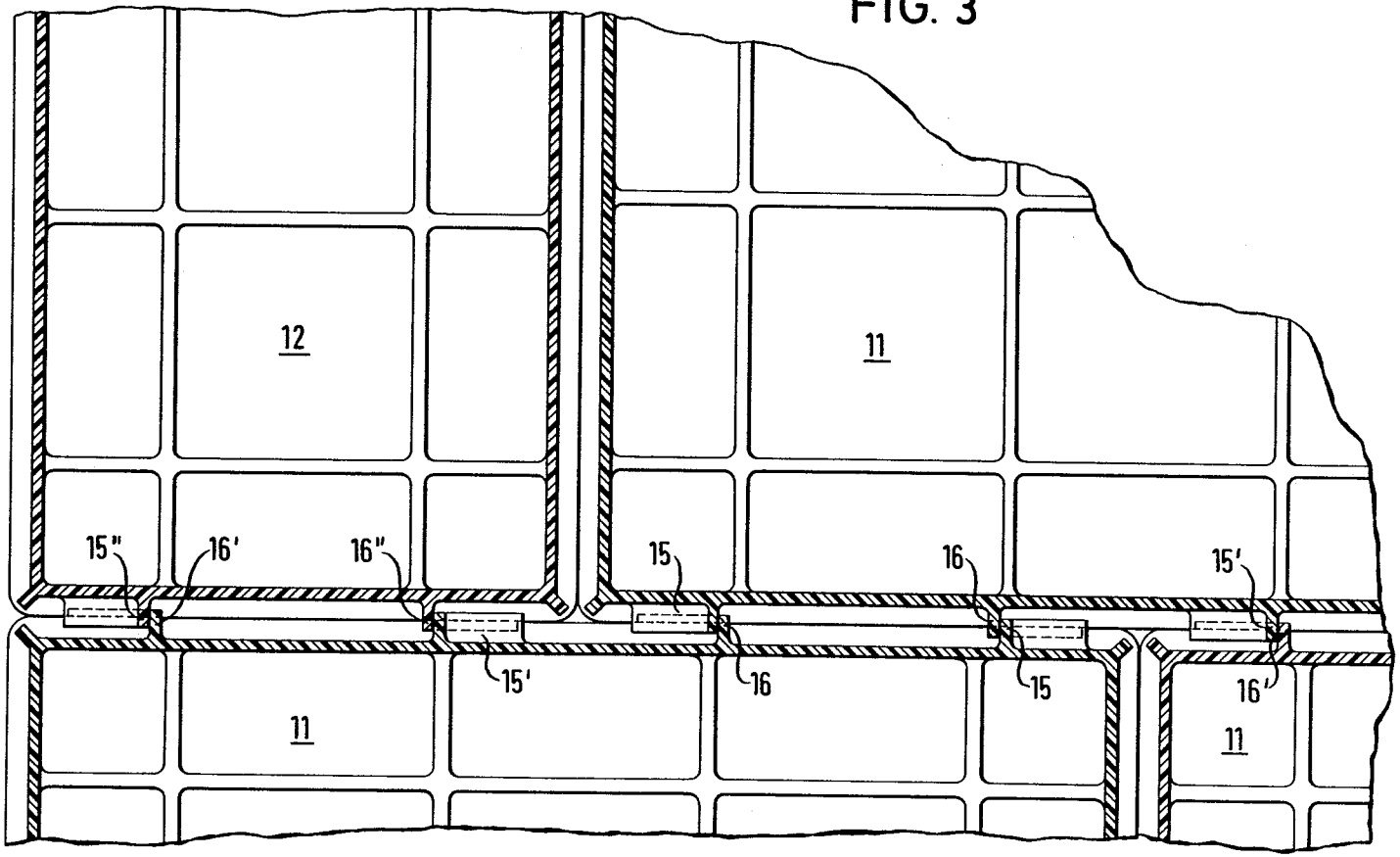
Figure 4:
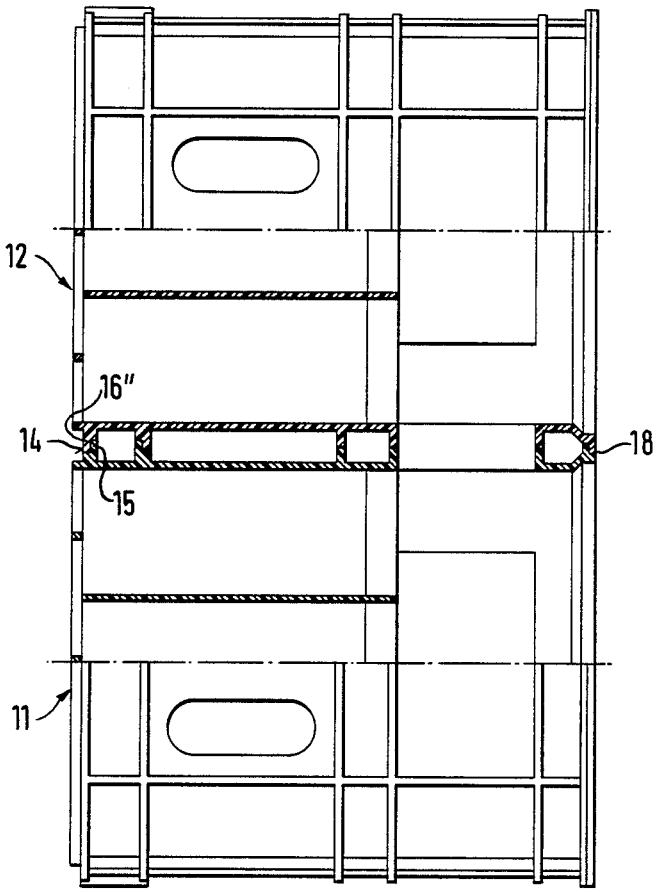
Figure 6:
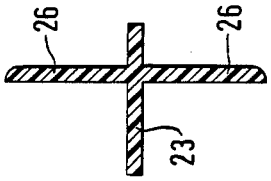
Figure 5:
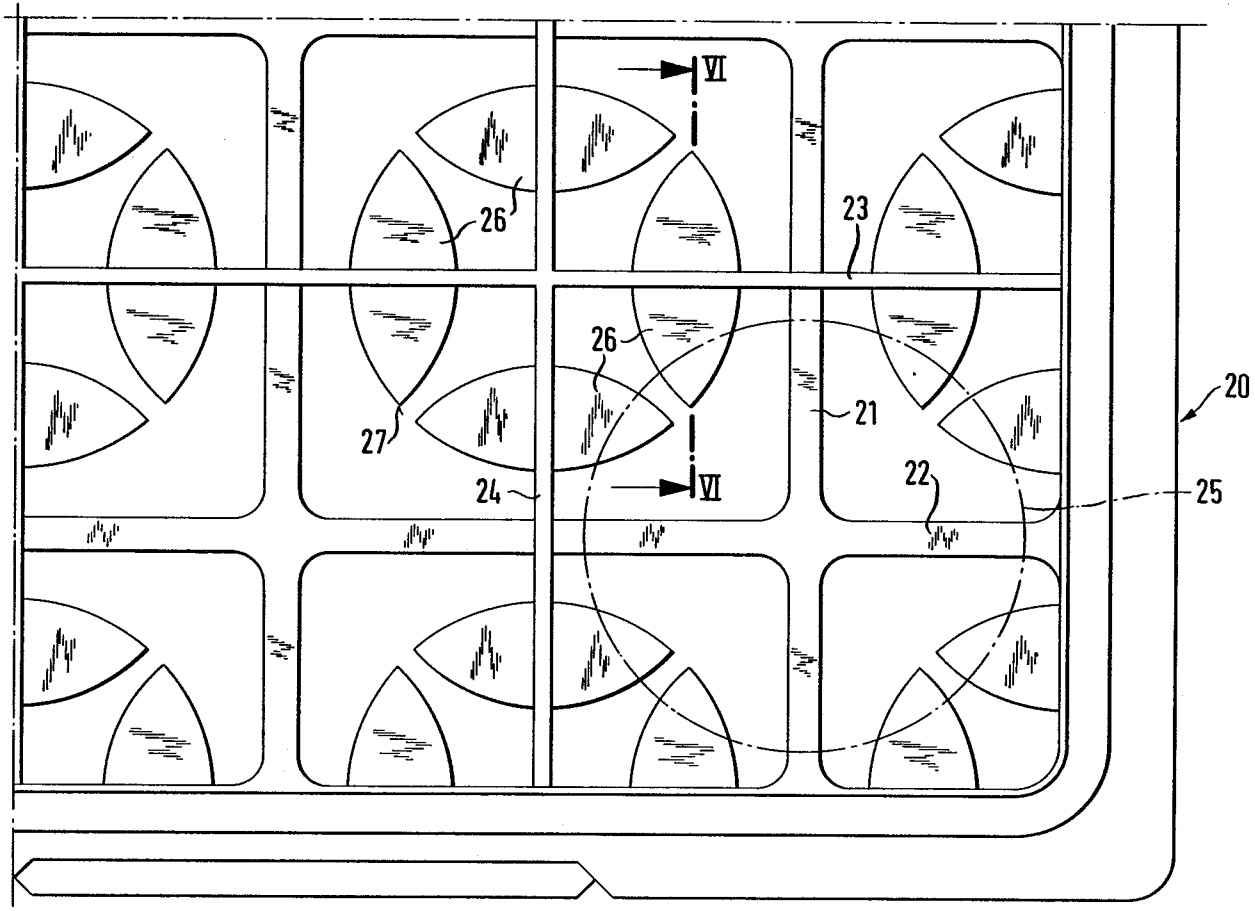
Figure 8:
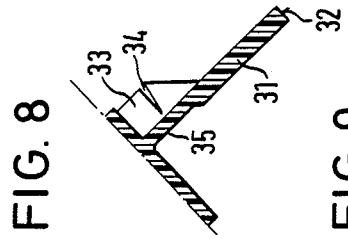
Figure 9:
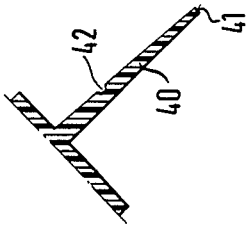
Figure 7:
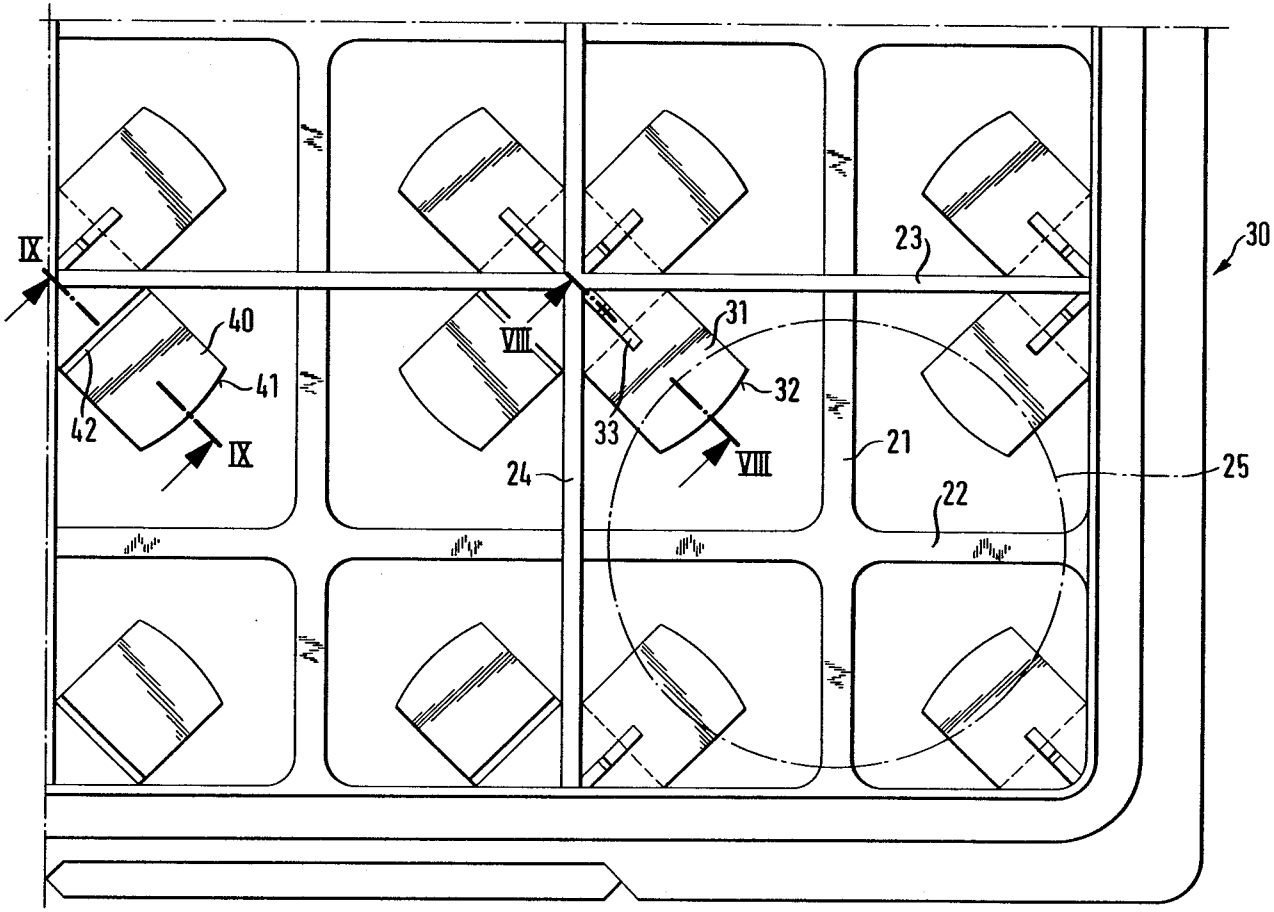

The invention will now be described in the following in more detail by way of drawings. In the drawings FIG. 1 shows a bottle rack in compound stacking arrangement comprising individual horizontally stacked crates according to the invention, FIG. 2 shows a side view of a great crate with two crates according to the invention stacked thereonto in an upright position, FIG. 3 shows a sectional view of crates stacked horizontally one upon another according to FIG. 1 and taken on ine IV—IV, respectively, according to FIG. 2, FIG. 4 shows a sectional view taken on line III—III of the representation according to FIG. 2, FIG. 5 shows a top plan view taken on a portion of a chest according to the invention, FIG. 6 shows a sectional view taken along line VI—VI of the representation according to FIG. 5, FIG. 7 shows a top plan view taken on a portion of another embodiment of the crate according to the invention, FIG. 8 shows a sectional view taken along line VIII—VIII of the representation according to FIG. 7, FIG. 9 shows a sectional view of another embodiment for a lamina taken along line IX—IX of the representation according to FIG. 7.

Prior to enlarging in more detail on the individual representations shown in the drawings it is to be stated that each of the features described is of inventively essential importance by itself or in connection with features of the drawing.

FIG. 1 shows a bottle rack 10 built up from two differently sized crates which are directly stacked one upon the other in a horizontal position. The greater crates are designated with 11 and the smaller ones with 12. The bottles accommodated are indicated by circles 13. It will be noted that the greater crates accommodate twelve bottles, such as wine bottles, for example, and the smaller crates accommodate six bottles. The smaller crates 12 are but half as long as the great crates 11 (as regards the outer dimensions thereof). Their height and width, on the contrary, is the same (see also the other Figures).

As will furthermore be seen from FIG. 1, the great crates 11 are stacked in a compound arrangement, i.e. respectively offset from each other by one half of their length in superimposed arrangement. Into the respective gaps then remaining a small crate 12 is inserted. With the aid of such a compound stacking arrangement it is possible to obtain a very high stacking height and a very high degree of strength of the stack.

In order to stack crates for bottles or the like one upon another it is known to provide deepenings or projections on the underside to co-operate with corresponding deepenings or projections on the upper side of the crate. In the case of the crates 11 and 12 as shown the arresting projections and deepenings are formed at the underside and on the upper side of the crates simultaneously forming the supporting surfaces, in such a manner that two smaller crates 12 may be arrested vertically on the other surface of one greater crate 11. It is also possible vice versa to place a greater crate vertically onto two juxtaposed smaller crates 12. Finally, great crates may also be stacked one upon another in a compound arrangement in such a manner that one half of an upper crate is supported by one half on a first great crate and by another half on the adjacent crate. A compound stacking arrangement with the chests arranged vertically, however, is not absolutely necessary, because in case of vertical stacking the stiffness of the chest is much higher than in case of stacking in a horizontal position as represented in FIG. 1.

From the side view according to FIG. 2 it may be seen that the outer surfaces of the crates 11, 12 are provided with horizontal and vertical ribs serving to reinforce the side walls. It will furthermore be recognized that there is a U-shaped recess 14 formed in the lower region of the ribs in the form of a horizontally disposed U opening to the left. Arranged inside the U-shaped recess 14 is a U-shaped projection 15 likewise in the form of a horizontally disposed U opening to the left. The recess 14 is disposed, for instance, 3 mm deeper than the outer surfaces of the remaining ribs, while the projection 15 is disposed about 3 mm higher than the ribs. A further projection 16 in the form of a horizontally disposed U opening to the right is likewise formed on the lefthand half of the side wall of the crate 11, said projection 16 likewise projecting further than the remaining ribs at the side wall by about 3 mm. It will furthermore be recognized that like recesses and projections, respectively, are arranged on the other side of the center line 17; they are disposed in the same arrangement as the projections 15, 16. The corresponding parts are provided with like reference numerals, but primed. It goes without saying that corresponding recesses and projections are formed on the opposite side wall, the side views of these side walls also being the same as regards the projections and deepenings.

The smaller crates 12 comprise projections 15″ and 16″ which are identical with the projections 15, 16 of the crate 11. They furthermore comprise a recess 14″ corresponding to the recess 14 of crate 11. It will be noted that in the horizontal position the great crates 11 may be stacked, one time, directly one upon another and, another time, may be stacked in superimposed arrangement but offset by one half from each other. It will furthermore be recognized that in the horizontal position the smaller crates 12 may be stacked respectively on one half of the side wall of the greater crate 11. It goes without saying that the embodiment shown only represents one example and that other supporting and interlocking possibilities are possible for crates 11 and 12 stacked one upon another in a horizontal position.

The interlocking arrangement to be derived from FIG. 3 in connection with the stacking of the crates in a horizontal position provides safety in all lateral directions, as may be noted from FIG. 4.

The remaining ribs of the crates come to lie one upon another in abutting engagement. Also at the open side the edges are in interlocking engagement with each other, as shown at 18.

FIG. 5 shows in a top plan view a crate 20 the bottom of which is formed by transverse and longitudinal webs 21, 22 forming a grating. The individual compartments are likewise formed by longitudinal and transverse webs 23, 24. In FIG. 5 the outline of the bottom of a bottle is indicated at 25 in a dash-dotted line. The compartment forming webs 23, 24 are disposed, for instance, in a position corresponding to two thirds of the height of the crates 20 and need but have a low height. Integrally formed with the corners of the compartments at the longitudinal and transverse webs 23, 24 are uniformly configured laminae 26 lancet-shaped in outline (see also FIG. 6). The laminae 26 are defined by arcuate lines at the outer surface thereof which are intersecting in a peak 27. The sides of the laminae 26 facing the center of a compartment form approximately a quarter of a circle having its center at the point of intersection of the longitudinal and transverse webs 23, 24. There are thus provided eight laminae per compartment. As the laminae are relatively thin, they will yield relatively easily upon insertion of a bottle 25 from above and, therefore, are not suited for instance to damage or displace labels, if they have not yet become fastly stuck. They may furthermore be so flexible that the bottles may slip into the compartments by their own weight with the laminae 26 yielding and thus deforming themselves. In a direction normal thereto, i.e. in the direction of the plane of the laminae 26, however, the latter display a certain stiffness, so that even in a horizontal position the bottles are safely accommodated in the compartments and thus cannot slip out to the front. Also the taking out of the bottles is relatively easy and does not lead to any damaging of the labels.

FIG. 7 shows a crate 30 in a top plan view, the basic construction of which resembles that of the crate 20 according to FIG. 5. Therefore, parts insofar similar to each other are provided with like reference numerals. In the embodiment according to FIG. 7, however, only four laminae are provided per compartment which are formed in the corners of the compartments as will be noted from FIG. 7. The side of the laminae 31 facing the center of the compartment is convexly curved on a circular arc as shown at 32. The laminae 31 are stiffened with the aid of ribs 33 arranged at the upper surface and extending directly into the corners of the compartments. As will be noted from FIG. 8, the ribs 33 are provided with an incision 34. In the zone opposite the ribs 33 the laminae are provided with a reduced thickness on the opposite side as shown at 35. It will be recognized that upon insertion of the bottles 25 from above the laminae will yield very easily. Upon being pulled out in a direction vice versa to the above they will yield easily only to a certain degree, until the gap 34 is closed. Following this, a greater effort of deformation is required. Thus, the bottles may be inserted more easily than they may be taken out. The insertion may be designed to be so easy that the bottles will completely slip into a compartment by their own weight.

An alternative to the embodiment according to FIG. 8 is shown in FIG. 9 with laminae 40 formed in a manner similar to the laminae 31 as regards the attachment and the outline thereof. They have, as will be recognized from FIG. 9, a maximum thickness in the compounding zone thereof, with the cross-section tapering in a direction towards the free side 41, which is likewise curved on a circular arc. At the end of the first third of the lamina 40 there is a groove 42 formed therein from above to extend over the entire width of the lamina 40. With the aid of such a groove a similar effect is obtained as with the aid of the rib 33 and the gap 34 in the embodiment according to FIG. 8.

I claim:

1. A system of stackable crates of synthetic material for bottles, especially wine bottles, comprising a plurality of crates each having compartmental subdivisions each adapted for accommodating one bottle, each crate having opposing first supporting surfaces on opposite end walls for stacking the crates in superimposed arrangement in a vertical position, each crate further having second supporting surfaces at at least two opposite side walls for stacking the crates in a horizontal position, each compartment having portions of elastically deformable material adapted to engage a bottle wall at circumferentially spaced intervals, characterized in that two sizes of crates are provided, the outer periphery of smaller crates being half the length but the same width as the greater ones, the second supporting surfaces of the smaller crates each having interlocking means formed thereon, the second supporting surfaces of each of said greater crates each having pairs of interlocking means, one positioned contiguous to the outer periphery of said second supporting surfaces, the other spaced inwardly towards the center of said second supporting surface, the interlocking means of said pairs being spaced apart a distance equal to the spacing of the interlocking means of the smaller crates and configured to interlock with the interlocking means of the smaller crates so that the stacked crates are interlocked with each other to be restrained against relative horizontal movement and so that the smaller crates may respectively be supported on the supporting surfaces of both halves of either of the opposing side walls of the greater crates and the greater crates may respectively be stacked in a horizontal position while being respectively offset from each other by half a length.

2. Crates according to claim 1, characterized in that the first supporting surfaces are arranged in such a manner that the smaller crates may respectively be supported in a vertical position on one half of the greater crates and, respectively, the greater crates may be stacked in a vertical position while being offset from each other by half the length.

3. Crates according to claim 1, characterized in that the supporting surfaces in one half of a side wall of the greater crate are designed identically with the supporting surfaces of the other side wall half.

4. Crates according to claim 1, characterized in that the second supporting surfaces are formed at arresting projections and arresting, deepenings each having a U-shaped configuration, respectively, and the arresting projections and arresting deepenings, respectively, of both halves of a side wall of the greater crates are alike.

5. Crates according to claim 1, characterized in that the portions of the deformable material are more flexible in the direction of insertion and the direction of pulling out, respectively, of the bottles than in a direction normal thereto.

6. Crates according to claim 5, characterized in that the flexible portions are formed of relatively thin laminae extending approximately in a plane normal to the direction of insertion of the bottles.

7. Crates according to claim 6, characterized in that one or two laminae are respectively arranged in the corners of one compartment with the outer surface thereof facing the compartment describing a circular arc.

8. Crates according to claim 6, characterized in that the laminae are shaped in such a manner that they are more easily deformable in the direction of insertion than in the direction of pulling out.

* * * * *